US007435908B2

(12) United States Patent
Jungkvist et al.

(10) Patent No.: US 7,435,908 B2
(45) Date of Patent: Oct. 14, 2008

(54) LOW VOLTAGE POWER CABLE WITH INSULATION LAYER COMPRISING POLYOLEFIN HAVING POLAR GROUPS, HYDROLYSABLE SILANE GROUPS, AND INCLUDING A SILANOL CONDENSATION CATALYST

(75) Inventors: Jonas Jungkvist, Göteborg (SE); Bernt-Ake Sultan, Stenungsund (SE); Wald Detlef, Antwerp (BE)

(73) Assignee: Borealis Technology Oy, Porvoo (FI)

( * ) Notice: Subject to any disclaimer, the term of this patent is extended or adjusted under 35 U.S.C. 154(b) by 0 days.

(21) Appl. No.: 10/576,654

(22) PCT Filed: Oct. 22, 2004

(86) PCT No.: PCT/EP2004/011979

§ 371 (c)(1),
(2), (4) Date: Sep. 4, 2007

(87) PCT Pub. No.: WO2005/041215

PCT Pub. Date: May 6, 2005

(65) Prior Publication Data

US 2008/0093103 A1 Apr. 24, 2008

(30) Foreign Application Priority Data

Oct. 24, 2003 (EP) ..... 03024371

(51) Int. Cl.
*H01B 7/00* (2006.01)

(52) U.S. Cl. ..... 174/110 R

(58) Field of Classification Search ..... 174/110 R, 174/110 AR, 120 R, 120 C, 120 AR, 120 SR
See application file for complete search history.

(56) References Cited

U.S. PATENT DOCUMENTS 5,225,469 A 7/1993 Maringer et al.
5,492,760 A * 2/1996 Sarma et al. ..... 428/378
5,686,546 A * 11/1997 Henderson ..... 528/12
6,667,098 B1 * 12/2003 Eklind et al. ..... 428/380

FOREIGN PATENT DOCUMENTS

EP 1 235 232 A1 8/2002

OTHER PUBLICATIONS

International Search Report corresponding to International Application No. PCT/EP2004/011979.
European Search Report corresponding to European Application No. EP 03 02 4371.

* cited by examiner

*Primary Examiner*—William H Mayo, III
(74) *Attorney, Agent, or Firm*—Fay Sharpe LLP

(57) ABSTRACT

A low voltage power cable having an insulation layer with a density below 1100 kg/m$^3$, which has a polyolefin having 0.002-4% mol of a compound that has polar groups and further having a compound that has hydrolysable silane groups and includes 0.0001-3% weight of a silanol condensation catalyst and a process of manufacturing such a cable.

16 Claims, 2 Drawing Sheets

LOW VOLTAGE POWER CABLE WITH INSULATION LAYER COMPRISING POLYOLEFIN HAVING POLAR GROUPS, HYDROLYSABLE SILANE GROUPS, AND INCLUDING A SILANOL CONDENSATION CATALYST

TECHNICAL FIELD

The present invention relates to a low voltage power cable comprising an insulation layer which comprises a polyolefin having polar groups, hydrolysable silane groups and includes silanol condensation catalyst to a process for the production thereof and to the use of said polyolefin in the production of an insulation layer for a low voltage power cable.

BACKGROUND OF THE INVENTION

Electric power cables for low voltages, i.e. voltages of below 6 kV, usually comprise an electric conductor which is coated with an insulation layer. Such a cable will in the following be referred to as single wire cable. Optionally, two or more of such single wire cables are surrounded by a common outermost sheath layer, the jacket.

The insulation layer of low voltage power cables usually is made of a polymer composition comprising a polymer base resin, such as a polyolefin. A material commonly used as a base resin is polyethylene.

Furthermore, in the final cable the polymer base resin usually is cross-linked.

In addition to the polymer base resin, polymer compositions for insulation layers of low voltage power cables usually contain further additives to improve the physical properties of the insulating layer of the electric cable and to increase its resistance to the influence of different surrounding conditions. The total amount of the additives is generally about 0.3 to 5% by weight, preferably about 1 to 4% by weight of the total polymer composition. The additives include stabilizing additives such as antioxidants to counteract decomposition due to oxidation, radiation, etc.; lubricating additives, such as stearic acid; and cross-linking additives such as peroxides to aid in the cross-linking of the ethylene polymer of the insulating composition.

In contrast to low voltage (<6 kV) power cables, medium (>6 to 68 kV) and high voltage (>68 kV) power cables are composed of a plurality of polymer layers extruded around an electric conductor. The electric conductor is coated first with an inner semiconductor layer followed by an insulating layer, and then an outer semiconductive layer all based on crosslinked polyethylene. Outside this cable core layers consisting of water barriers, metallic screens, bedding (polymer layer making the cable round) and on the outside a polyolefin based sheath layer are commonly applied. The thickness of the insulation layer of these cables is in the range of 5 to 25 mm.

As in low voltage power cables the insulation layer is usually much thinner, e.g. 0.4 to 3 mm, and directly coated onto the electric conductor and the insulation layer being the only layer surrounding each single conducting core, it is of great importance that the insulation layer must have good mechanical properties, like elongation at break and tensile strength at break. However, when this thin polyolefin layer is extruded towards a cold conductor, its mechanical properties are heavily deteriorated. For this reason, when extruding insulation layers comprising polyolefins on conductors, usually preheated conductors are used, this, however, being a disadvantage compared to materials, as e.g., PVC. The mechanical properties of the thin polyolefin layer are furthermore negatively affected by plastisizer migrating into it from the surrounding bedding and sheathing layers applied outside the cable core(s), which still commonly is PVC based in low voltage cables.

Furthermore, cable joints between low voltage power cables preferably are formed in such a way that, after stripping off part of the insulation layer at the end of both cables to be joined and connecting the electric conductors, a new insulation layer covering the joint conductors is often formed of a polyurethane polymer. Accordingly, it is important that the polymer composition of the original insulation layer shows a good adhesion to the polyurethane polymer used for restoring the insulation layer so that the layer is not disrupted even under mechanical stress at the cable joints.

Still further, as insulation layers of low voltage power cables usually are formed by direct extrusion onto a conductor, it is important that the polymer composition used for the insulation layer shows good extrusion behavior and, after extrusion, retains its good mechanical properties.

WO 95/17463 describes the use of a sulphonic acid as a condensation catalyst added in a masterbatch which comprises 3-30% by weight of LD, PE or EBA.

WO 00/36612 describes a Medium/High voltage (MV/HV) power cable with good electrical properties, especially long time properties. These MV/HV cables always have an inner semiconductive layer and outside that layer an insulation layer. The adhesion between these layers is always good since they are made of essentially the same material, i.e. polyethylene compounds. In contrast, the present invention is directed to a low voltage power cable and inter alia solves the problem of adhesion of the insulation layer to the conductor and problems associated with extruding directly on a conductor.

WO 02/88239 teaches how additives shall be chosen to an acid condensation catalyst.

U.S. Pat. No. 5,225,469 describes polymer compositions based on ethylene-vinyl ester and ethylene-alkyl acrylate copolymers which can be crosslinked to provide insulation coatings for wire and cable products.

EP 1 235 232 teaches that the coating layer of cables based on a composition material comprises polar groups and inorganic material.

Accordingly, it is the object of the present invention to provide a low voltage power cable with an insulation layer which shows good mechanical properties and, at the same time, shows good adhesion to polyurethane polymers and after extrusion retains its good mechanical properties. It is a further object of the invention to provide a low voltage power cable with an insulation layer having an improved resistance to deterioration of mechanical properties caused by migration of plasticisers from PVC into the layer.

BRIEF SUMMARY OF THE INVENTION

The present invention is based on the finding that such a low voltage power cable can be provided if the insulation layer contains a polymer with 0.02 to 4 mol % of a compound having polar groups and further comprising a compound having hydrolysable silane groups and includes 0.0001 to 3 wt.-% of a silanol condensation catalyst.

The present invention therefore provides a low voltage power cable comprising an insulation layer with a density of below 1100 kg/m$^3$ which comprises a polyolefin comprising 0.02 to 4 mol % of a compound having polar groups, and further comprises a compound having hydrolysable silane groups and includes 0.0001 to 3 wt.-% of a silanol condensation catalyst.

It has surprisingly been found that an insulation layer which comprises a polyolefin comprising 0.02 to 4 mol % of a compound having polar groups and further comprises a compound having hydrolysable silane groups and includes 0.0001 to 3 wt.-% of a silanol condensation catalyst decisively improves the adhesion towards polyurethane polymers, so that durable joints between low voltage power cables according to the invention can be made with polyurethane polymer fillers.

At the same time, the insulation layer of the cable fulfills the demanding requirements for the mechanical properties of a low power voltage cable. In particular, the elongation at break is improved. LV cables are often installed in buildings. Single wire cables usually are installed in a conduit and during installation the single wire cables are drawn through long conduits. Sharp corners and especially other installations could cause damages to the insulation layer of the cable. The low voltage power cable according to the invention due to its improved elongation at break effectively prevents such breaks during installation.

Furthermore, the insulation layer shows an improved extrusion behavior insofar as no preheating or a smaller degree of preheating of the conductor is necessary during the extrusion process for obtaining good mechanical properties of the final insulation layer.

Finally, the insulation layer retains good mechanical properties when aged with PVC.

The low voltage power cable according to the invention has carefully been optimized in regard to all required parameters. The combination of mechanical strength, with low absorption of PVC plasticicers are the key parameters. Another important aspect of this invention is the low amount of polar groups. This is especially important to low voltage power cables, since they must be very cost efficient. They are usually made with only one combined insulation layer and jacketing layer which is mostly quite thin. It cannot be stressed enough how important it is that this layer has high electrical resistance and good mechanical strength. This is accomplished with the low amount of polar groups. Another aspect of the invention is making a compound with good abrasion properties. If the composition comprises a high amount of copolymers the composition will be softer. This means that the abrasion will be lower. Abrasion is important in industrial applications with, for example, high degrees of vibrations. This is another reason why the amount of polar groups must be low.

The expressing "a compound having polar groups" is intended to cover both the case where only one chemical compound with polar groups is used and the case where a mixture of two or more such compounds is used.

Preferably, the polar groups are selected from siloxane, amide, anhydride, carboxylic, carbonyl, hydroxyl, ester and epoxy groups.

The said polyolefin may for example be produced by grafting of a polyolefin with a polar-group containing compound, i.e. by chemical modification of the polyolefin by addition of a polar group containing compound mostly in a radical reaction. Grafting is e.g. described in U.S. Pat. No. 3,646,155 and U.S. Pat. No. 4,117,195.

It is, however, preferred that said polyolefin is produced by copolymerisation of olefinic monomers with comonomers bearing polar groups. In such cases, the complete comonomer is designated by the expression "compound having polar groups". Thus, the weight fraction of the compound having polar groups in a polyolefin which has been obtained by copolymerization may simply be calculated by using the weight ratio of the monomers and comonomers bearing polar groups that have been polymerised into the polymer. For example, where said polyolefin is produced by copolymerization of olefin monomers with a vinyl compound comprising a polar group, also the vinyl part, which after polymerization forms part of the polymer backbone, contributes to the weight fraction of the "compound having polar groups".

As examples of comonomers having polar groups may be mentioned the following: (a) vinyl carboxylate esters, such as vinyl acetate and vinyl pivalate, (b) (meth)acrylates, such as methyl(meth)acrylate, ethyl(meth)acrylate, butyl(meth)acrylate and hydroxyethyl(meth)acrylate, (c) olefinically unsaturated carboxylic acids, such as (meth)acrylic acid, maleic acid and fumaric acid, (d) (meth)acrylic acid derivatives, such as (meth)acrylonitrile and (meth)acrylic amide, and (e) vinyl ethers, such as vinyl methyl ether and vinyl phenyl ether.

Amongst these comonomers, vinyl esters of monocarboxylic acids having 1 to 4 carbon atoms, such as vinyl acetate, and (meth)acrylates of alcohols having 1 to 4 carbon atoms, such as methyl (meth)acrylate, are preferred. Especially preferred comonomers are butyl acrylate, ethyl acrylate and methyl acrylate. Two or more such olefinically unsaturated compounds may be used in combination. The term "(meth)acrylic acid" is intended to embrace both acrylic acid and methacrylic acid.

Preferably, said polyolefin comprises at least 0.05 mol, more preferably 0.1 mol % and still more preferably 0.2 mol %, of a polar compound having polar groups. Further, the polyolefin compound comprises not more than 2.5 mol %, more preferably not more than 2.0 mol %, and still more preferably not more than 1.5 mol % of a polar compound having polar groups.

In a preferred embodiment, said polyolefin is an ethylene homo- or copolymer, preferably homopolymer.

The polyolefin used for the production of the insulation layer preferably is crosslinked after the low voltage power cable has been produced by extrusion. A common way to achieve such cross-linking is to include a peroxide into the polymer composition which after extrusion is decomposed by heating, which in turn effects cross-linking. Usually, 1 to 3 wt.-%, preferably about 2 wt.-% of peroxide cross-linking agent based on the amount of polyolefin to be crosslinked is added to the composition used for the production of the insulation layer.

However, it is preferred to effect cross-linking by way of incorporation of cross-linkable groups to the polyolefin comprising a compound having polar groups used in the production of the insulation layer.

Hydrolysable silane groups may be introduced into the polymer either via grafting, as e.g. described in U.S. Pat. No. 3,646,155 and U.S. Pat. No. 4,117,195, or preferably via copolymerization of silane groups containing comonomers.

The comonomer with silane groups is designated by the expression "compound having silane groups".

Preferably, the silane group containing polyolefin has been obtained by copolymerization. In the case of polyolefins, preferably polyethylene, the copolymerization is preferably carried out with an unsaturated silane compound represented by the formula $$R^1SiR^2_qY_{3-q} \quad (I)$$

wherein $R^1$ is an ethylenically unsaturated hydrocarbyl, hydrocarbyloxy or (meth)acryloxy hydrocarbyl group, $R^2$ is an aliphatic saturated hydrocarbyl group, Y which may be the same or different, is a hydrolysable organic group and q is 0, 1 or 2.

Special examples of the unsaturated silane compound are those wherein $R^1$ is vinyl, allyl, isopropenyl, butenyl, cyclohexanyl or gamma-(meth)acryloxy propyl; Y is methoxy, ethoxy, formyloxy, acetoxy, propionyloxy or an alkyl- or arylamino group; and $R^2$, if present, is a methyl, ethyl, propyl, decyl or phenyl group.

A preferred unsaturated silane compound is represented by the formula $$CH_2{=}CHSi(OA)_3 \quad (II)$$

wherein A is a hydrocarbyl group having 1-8 carbon atoms, preferably 1-4 carbon atoms.

The most preferred compounds are vinyl trimethoxysilane, vinyl bismethoxyethoxysilane, vinyl triethoxysilane, gamma-(meth)acryl-oxypropyltrimethoxysilane, gamma (meth)acryloxypropyltriethoxysilane, and vinyl triacetoxysilane.

The copolymerization of the olefin, e.g. ethylene, and the unsaturated silane compound may be carried out under any suitable conditions resulting in the copolymerization of the two monomers.

The silane-containing polymer according to the invention suitably contains 0.001 to 15% by weight of the silane group containing compound, preferably 0.01 to 5% by weight, most preferably 0.1 to 2% by weight.

Examples for acidic silanol condensation catalysts comprise Lewis acids, inorganic acids such as sulphuric acid and hydrochloric acid, and organic acids such as citric acid, stearic acid, acetric acid, sulphonic acid and alkanoric acids as dodecanoic acid.

Preferred examples for a silanol condensation catalyst are sulphonic acid and tin organic compounds.

It is further preferred that the silanol condensation catalyst is a sulphonic acid compound according to formula (III)

$$ArSO_3H \quad (III)$$

or a precursor thereof, Ar being a hydrocarbyl substituted aryl group and the total compound containing 14 to 28 carbon atoms.

Preferably, the Ar group is a hydrocarbyl substituted benzene or naphthalene ring, the hydrocarbyl radical or radicals containing 8 to 20 carbon atoms in the benzene case and 4 to 18 atoms in the naphthalene case.

It is further preferred that the hydrocarbyl radical is an alkyl substituent having 10 to 18 carbon atoms and still more preferred that the alkyl substituent contains 12 carbon atoms and is selected from dodecyl and tetrapropyl. Due to commercial availability it is most preferred that the aryl group is a benzene substituted group with an alkyl substituent containing 12 carbon atoms.

The currently most preferred compounds of formula (III) are dodecyl benzene sulphonic acid and tetrapropyl benzene sulphonic acid.

The silanol condensation catalyst may also be precursor of a compound of formula (III), i.e. a compound that is converted by hydrolysis to a compound of formula (III). Such a precursor is for example the acid anhydride of the sulphonic acid compound of formula (III). Another example is a sulphonic acid of formula (III) that has been provided with a hydrolysable protective group as e.g. an acetyl group which can be removed by hydrolysis to give the sulphonic acid of formula (III). The silanol condensation catalyst is used in an amount from 0.0001 to 3 wt.-%.

The preferred amount of silanol condensation catalyst is from 0.001 to 2 wt % and more preferably 0.005 to 1 weight % based on the amount of silanol groups containing polyolefin in the polymer composition used for the insulation layer.

The effective amount of catalyst depends on the molecular weight of the catalyst used. Thus, a smaller amount is required of a catalyst having a low molecular weight than a catalysts having a high molecular weight.

If the catalyst is contained in a master batch it is preferred that it comprises the catalyst in an amount of 0.02 to 5 wt %, more preferably about 0.05 to 2 wt %.

The insulation layer of the low voltage power cable preferably has a thickness of 0.4 mm to 3.0 mm, preferably 2 mm or lower, depending on the application.

Preferably, the insulation is directly coated onto the electric conductor.

Furthermore, the polymer composition comprising a polyolefin comprising a compound having polar groups and further a compound having hydrolysable silane groups and includes a silanol condensation catalyst used for the production of low voltage cables according to the invention allows for the direct extrusion of the insulating layer onto the non-preheated or only moderately preheated conductor without a deterioration of the mechanical properties of the final insulation layer.

Therefore, the present invention also provides a process for producing a low voltage power cable comprising a conductor and an insulation layer with a density of below 1100 kg/m$^3$ which layer comprises a polyolefin comprising 0.02 to 4 mol % of a compound having polar groups which process comprises extrusion of the insulation layer onto the conductor which is preheated to a maximum temperature of 65° C., preferably preheated to a maximum temperature of 40° C., and still more preferably onto the non-preheated conductor.

Optionally, between the conductor and the insulation layer, a primer can be applied.

Still further, the present invention pertains to the use of a polyolefin comprising 0.02 to 4 mol % of a compound having polar groups in the production of an insulation layer with a density of below 1100 kg/m$^3$ for a low voltage power cable.

BRIEF DESCRIPTION OF THE DRAWINGS

The present invention will now be further illustrated by way of examples and the following figures.

DETAILED DESCRIPTION OF THE EMBODIMENTS

Examples

Figure 1:
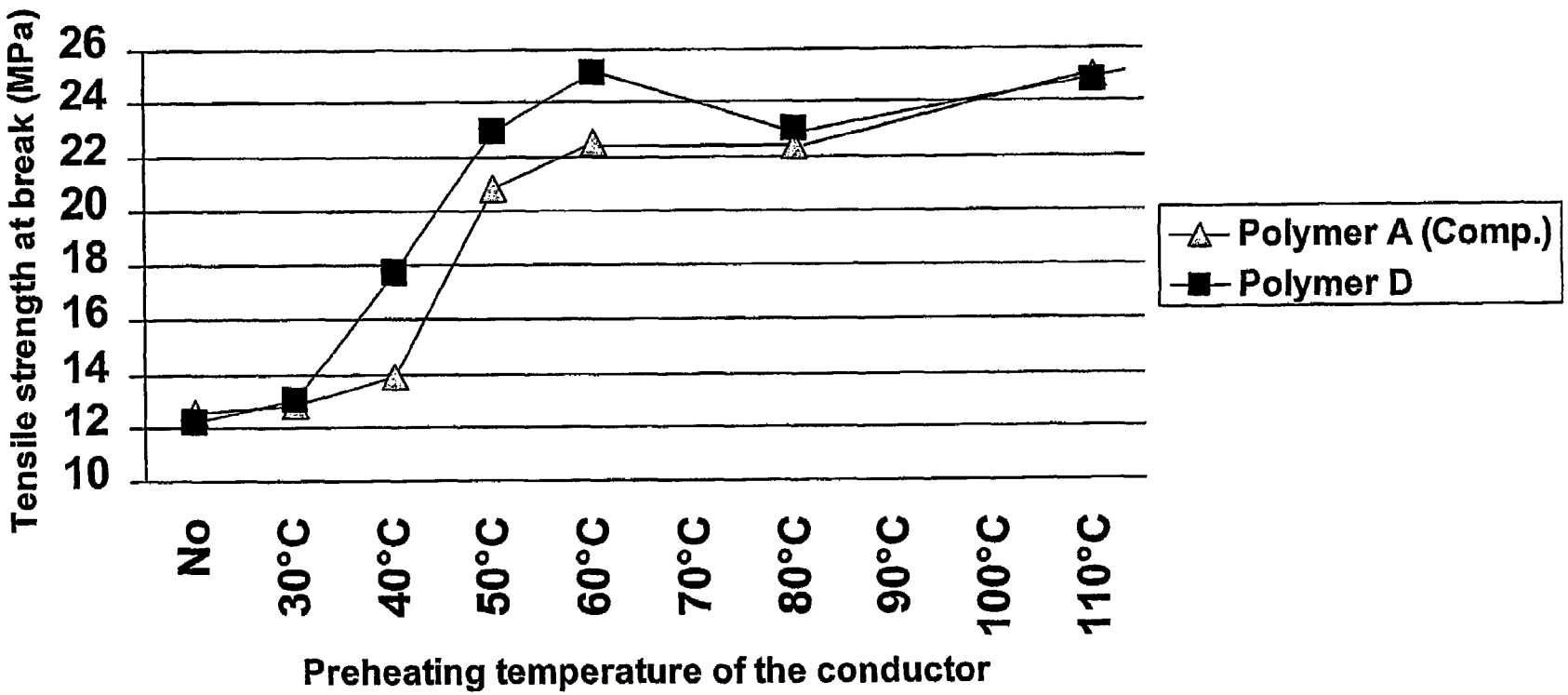
FIG. 1 shows the tensile strength at break as a function of the preheating temperature of the conductor for polymer A (Comp.) and polymer D.

1. Compositions Used for Production of Insulation Layers a) Polymer A (comparative) is a ethylene copolymer containing 0.23 mol % (1.25 wt %) of vinyltrimethoxysilane (VTMS), which has been obtained by free radical copolymerisation of ethylene monomers and VTMS comonomers. Polymer A has a density of 922 kg/m$^3$ and an $MFR_2$ (190° C., 2.16 kg) of 1.00 g/10 min.

b) Polymer B (comparative) is a ethylene copolymer containing 0.25 mol % (1.3 wt %) of vinyltrimethoxysilane (VTMS), which has been obtained in the same way as polymer A. Polymer B has a density of 925 kg/m$^3$ and an MFR$_2$ (190° C., 2.16 kg) of 1.1 g/10 min.

c) Polymer C is a ethylene copolymer containing 0.25 mol % (1.3 wt %) of vinyltrimethoxysilane (VTMS) and 0.33 mol % (1.5 wt %) of butyl acrylate (BA), which has been obtained in the same way as polymer A, except that during polymerisation butylacrylate comonomers were added. Polymer C has a density of 925 kg/m$^3$ and an MFR$_2$ (190° C., 2.16 kg) of 0.9 g/10 min.

d) Polymer D is a ethylene copolymer containing 0.26 mol % (1.3 wt %) of vinyltrimethoxysilane (VTMS) and 0.91 mol % (4.0 wt %) of butyl acrylate (BA), which has been obtained in the same way as polymer A, except that during polymerisation butylacrylate comonomers were added. Polymer D has a density of 925 kg/m$^3$ and an MFR$_2$ (190° C., 2.16 kg) of 0.8 g/10 min.

e) Polymer E is a ethylene copolymer containing 0.30 mol % (1.5 wt %) of vinyltrimethoxysilane (VTMS) and 1.6 mol % (7 wt %) of butyl acrylate (BA), which has been obtained in the same way as polymer A, except that during polymerisation butylacrylate comonomers were added. Polymer E has an MFR$_2$ (190° C., 2.16 kg) of 1.69 g/10 min.

f) Polymer F is a ethylene copolymer containing 0.34 mol % (1.7 wt %) of vinyltrimethoxysilane (VTMS) and 2.9 mol % (12 wt %) of butyl acrylate (BA), which has been obtained in the same way as polymer A, except that during polymerisation butylacrylate comonomers were added. Polymer F has a density of 925 kg/m$^3$ and an MFR$_2$ (190° C., 2.16 kg) of 1.50 g/10 min.

g) Polymer G is a ethylene copolymer containing 1.8 mol % (8 wt %) of butyl acrylate (BA), which has been obtained in the same way as polymer A, except that during polymerisation butylacrylate comonomers were added, but no silane group containing comonomers. Polymer G has a density of 923 kg/m$^3$ and an MFR$_2$ (190° C., 2.16 kg) of 0.50 g/10 min.

h) Polymer H is a ethylene copolymer containing 4.3 mol % (17 wt %) of butyl acrylate (BA), which has been obtained in the same way as polymer A, except that during polymerisation butylacrylate comonomers were added, but no silane group containing comonomers. Polymer H has a density of 925 kg/m$^3$ and an MFR$_2$ (190° C., 2.16 kg) of 1.20 g/10 min.

i) Polymer I is an ethylene copolymer containing 0.43 mol % (1.9 wt %) vinyltrimethoxysilane (VTMS) and 4.4 mol % (17 wt %) of butylacrylate (BA), which has been obtained in the same way as polymer A, except that polymerisation butylacrylate comonomers were added. Polymer I has an MFR$_2$ (190° C., 2.16 kg) of 4-5 g/10 min and a density of 928 kg/m$^3$.

j) Catalyst masterbatch CM-A consists of 1.7 wt % dodecylbenzene-sulphonic acid crosslinking catalyst, drying agent and antioxidants compounded into an ethylene butyl acrylate (BA) copolymer with an BA content of 17 wt-% and MFR$_2$=8 g/10 min.

k) Polyurethane based cast resin PU 300 is a naturally coloured unfilled two component system intended to be used for 1 kilovolt cable joints (in accordance with VDE 0291 teil 2 type RLS-W). It has a density of 1225 kg/m$^3$ and a hardness (Shore D) of −55. The cast resin is produced by Höhne GmbH.

l) Polyurethane based cast resin PU 304 is a blue filled two component system intended to be used for 1 kilovolt cable joints. It has a density of 1340 kg/m$^3$ and a hardness (Shore D) of 60. The cast resin is produced by Höhne GmbH.

The amount of butyl acrylate in the polymers was measured by Fourier Transform Infrared Spektroscopy (FTIR). The weight-%/mol-% of butyl acrylate was determined from the peak for butyl acrylate at 3450 cm$^{-1}$, which was compared to the peak of polyethylene at 2020 cm$^{-1}$.

The amount of vinyl trimethoxy silane in the polymers was measured by Fourier Transform Infrared Spektroscopy (FTIR). The weight-% of vinyl trimethoxy silane was determined from the peak for silane at 945 cm$^{-1}$, which was compared to the peak of polyethylene at 2665 cm$^{-1}$.

2. Production of the Low Voltage Power Cables

Cables consisting of an 8 mm$^2$ solid aluminium conductor and an insulation layer thickness of 0.8 mm (for the samples in table 1) and 0.7 mm (for the samples in FIG. 1 and FIG. 2) were produced in a Nokia-Maillefer 60 mm extruder at a line speed of 75 m/min by applying the following conditions:

Die: Pressure (wire guide with a diameter of 3.65 and a pressure die with a diameter of 5.4 mm for the samples in table 1 and wire guide with a diameter of 3.0 and a pressure die with a diameter of 4.4 mm for the samples in FIG. 1 and FIG. 2).

Conductor: Non-preheated, if not anything else mentioned.

Cooling bath temperature: 23° C.

Screws: Elise

Figure 2:
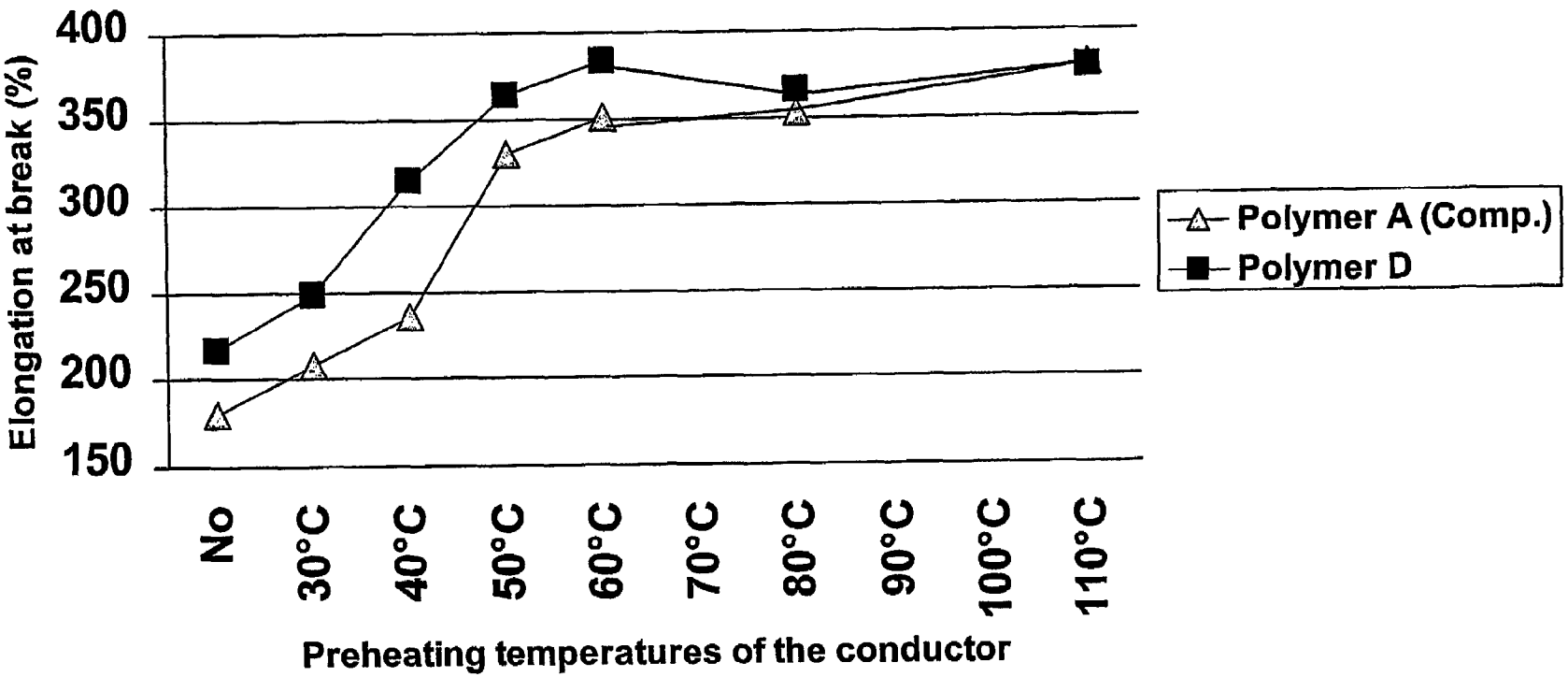
FIG. 2 shows the elongation at break as a function of the preheating temperature of the conductor for polymer A (Comp.) and polymer D.

Temperature profile: 150, 160, 170, 170, 170, 170, 170, 170° C. for the samples in Table 1, FIG. 1 and FIG. 2.

For the crosslinked samples, the catalyst masterbatch was dry blended into the polymers prior to extrusion.

3. Test Methods a) Mechanical and Adhesive Properties

The mechanical evaluation of the cables was performed according to ISO 527 and the test of adhesion to polyurethane was based on VDE 0472-633.

b) Ageing with PVC

A plaques of the insulation material is placed in an oven at 100° C. for 168 hours. PVC plaques are placed on both side of the insulation material plaque. Dumbells are punched out from the plaques after the testing and then conditioned in 23° C. and 50% humidity for 24 hours. The tensile tests are then performed according to ISO 527. The samples that have been aged together with PVC are also weighten before and after ageing. Samples that have been aged in an oven at 100° C. for 168 hours without contact to PVC and also other samples that are unaged have been tested according to ISO 527.

4. Results

The results given in Table 1 show that both for crosslinked and for non-crosslinked (thermoplastic) polymers E, F and G, H, respectively, the mechanical properties are improved upon incorporation of the polar group containing butyl acrylate comonomers into the polymers.

Furthermore, in Table 2 it is shown that the adhesion to polyurethane of polymers C and D is improved even for low amounts of incorporated butylacrylate so that good adhesion to polyurethane according to VDE 0472-633 is obtained.

FIG. 1 and FIG. 2 show that the mechanical properties of low voltage power cables according to the invention are improved when the insulation layer is extruded at the same conductor preheating temperature as the comparative material. In particular, for the elongation at break, this applies also for the case where no preheating at all is applied.

Table 3 shows, surprisingly, that polar groups containing insulation materials have improved resistance to the deterioration of the mechanical properties caused by the plasticiser in the PVC even then the polar groups containing insulation material adsorb more plasticiser compared to the reference.

TABLE 1

| | Material | | | | | |
|---|---|---|---|---|---|---|
| | Polymer A + 5 weight-% CM-A (Comparative) | Polymer E + 5 weight-% CM-A | Polymer F + 5 weight-% CM-A | Polymer A (Comparative) | Polymer G | Polymer H |
| Comments | | Crosslinked | | | Thermoplastic | |
| $MFR_2$ (g/10 min) | 1.00 | 1.69 | 1.50 | 1.00 | 0.50 | 1.20 |
| Density (kg/m$^3$) | 922 | — | 925 | 922 | 923 | 925 |
| VTMS-content (weight-%) | 1.25 | 1.5 | 1.7 | 1.25 | 0 | 0 |
| BA-content (weight-%) | 0 | 7 | 12 | 0 | 8 | 17 |
| Elongation at break (%) | 229 | 285 | 272 | 279 | 403 | 530 |
| Tensile strength at break (MPa) | 15.5 | 15.9 | 17.7 | 11.0 | 11.9 | 11.2 |

TABLE 2

| | Relative adhesion to polyurethane, % | |
|---|---|---|
| Cast resin type | Giessharz PU300 1 kV, unfilled | Giessharz PU304 Blau 1 kV, filled |
| Polymer A + 5 weight-% CM-A (Comparative) | 100 | 100 |
| Polymer C + 5 weight-% CM-A | 120 | 500 |
| Polymer D + 5 weight. % CM-A | 290 | 360 |
| 85 weight-% Polymer A + 10 weight-% Polymer I + 5 weight-% CM-A | No data available | 290 |

TABLE 3

| Material | Polymer A + 5 weight-% CM-A (comparative) | Polymer D + 5 weight-% CM-A |
|---|---|---|
| BA-content (weight-%) | 0 | 4 |
| Elongation at break | | |
| Difference after 168 hours in 100 degrees C. without PVC (%) | −11 | −19 |
| Difference after 168 hours in 100 degrees C. with PVC (%) | −42 | −14 |
| Tensile stress at break | | |
| Difference after 168 hours in 100 degrees C. without PVC (%) | 1 | −12 |
| Difference after 168 hours in 100 degrees C. with PVC (%) | −39 | −13 |
| Plasticiser adsorption | | |
| Weight increase after 168 hours in 100 degrees C. with PVC (%) | 19 | 31 |

The invention claimed is:

1. A low voltage power cable comprising an insulation layer with a density below 1100 kg/m$^3$ which comprises a polyolefin having incorporated 0.02 to 4 mol % of a compound having polar groups, and further having incorporated a compound having hydrolysable silane groups, and which further comprises 0.0001 to 3 wt.-% of a silanol condensation catalyst.

2. A low voltage power cable according to claim 1, wherein the polar groups are selected from siloxane, amide, anhydride, carboxylic, carbonyl, hydroxyl, ester and epoxy groups.

3. A low voltage power cable according to claim 2, wherein the compound having polar groups is butyl acrylate.

4. A low voltage power cable according to claim 3 wherein the thickness of the insulation layer is 0.4 to 3 mm.

5. A low voltage power cable according to claim 2 wherein the thickness of the insulation layer is 0.4 to 3 mm.

6. A low voltage power cable according to claim 1, wherein the polyolefin comprises 0.1 to 2.0 mol % of the compound having polar groups.

7. A low voltage power cable according to claim 6 wherein the thickness of the insulation layer is 0.4 to 3 mm.

8. A low voltage power cable according to claim 1, wherein the polyolefin comprises 0.001 to 15 wt. % of the compound having silane groups.

9. A low voltage power cable according to claim 8, wherein the polymer composition further comprises a sulphonic acid or an organic tin compound as a silanol condensation catalyst.

10. A low voltage power cable according to claim 8 wherein the thickness of the insulation layer is 0.4 to 3 mm.

11. A low voltage power cable according to claim 1, wherein the polymer composition further comprises a sulphonic acid or an organic tin compound as a silanol condensation catalyst.

12. A low voltage power cable according to claim 11 wherein the thickness of the insulation layer is 0.4 to 3 mm.

13. A low voltage power cable according to claim 1, wherein the thickness of the insulation layer is 0.4 to 3 mm.

14. A process for producing a low voltage power cable comprising a conductor and an insulation layer, which layer comprises a polyolefin having incorporated 0.02 to 4 mol % of a compound having polar groups, and further having incorporated a compound having hydrolysable silane groups, and which further comprises 0.0001 to 3 wt % of a silanol condensation catalyst, which process comprising extrusion of an insulation layer on a conductor which is preheated to a maximum temperature of 65° C.

15. A process according to claim 14 wherein the extrusion of the insulation layer is performed on the non-preheated conductor.

16. The production of an insulation layer for a low voltage power cable comprising forming said insulation layer from a polyolefin comprising 0.02 to 4 mol % of a compound having polar groups and further having incorporated a compound having hydrolysable silane groups, and which further comprises 0.0001 to 3 wt % of a silanol condensation catalyst.

* * * * *